US009909359B2

(12) United States Patent
Bachmann

(10) Patent No.: US 9,909,359 B2
(45) Date of Patent: Mar. 6, 2018

(54) COVERING DEVICE

(71) Applicant: Bernhard Bachmann, Bretten (DE)

(72) Inventor: Bernhard Bachmann, Bretten (DE)

( * ) Notice: Subject to any disclaimer, the term of this patent is extended or adjusted under 35 U.S.C. 154(b) by 0 days.

(21) Appl. No.: 14/441,842

(22) PCT Filed: Nov. 7, 2013

(86) PCT No.: PCT/EP2013/003340

§ 371 (c)(1),
(2) Date: May 9, 2015

(87) PCT Pub. No.: WO2014/072050

PCT Pub. Date: May 15, 2014

(65) Prior Publication Data

US 2015/0292260 A1 Oct. 15, 2015

(30) Foreign Application Priority Data

Nov. 9, 2012 (DE) ..... 10 2012 021 924

(51) Int. Cl.
*E06B 9/15* (2006.01)
*E06B 9/17* (2006.01)

(52) U.S. Cl.
CPC ..... *E06B 9/15* (2013.01); *E06B 9/17* (2013.01); *E06B 2009/1533* (2013.01); *E06B 2009/1538* (2013.01)

(58) Field of Classification Search
CPC ..... E06B 2009/405; E06B 9/15; E06B 9/17; E06B 2009/1533
USPC ..... 160/120, 122, 133, 264, 352; 52/108
See application file for complete search history.

(56) References Cited

U.S. PATENT DOCUMENTS 1,925,815 A * 9/1933 Nicolson ..... E04H 6/02 135/119
2,060,582 A * 11/1936 Leffert ..... E04F 10/0662 160/120
2,642,162 A * 6/1953 Tobias ..... E04B 1/344 52/108
3,853,168 A 12/1974 Wrono
4,651,480 A * 3/1987 Kramer ..... E04H 12/185 182/41
6,705,378 B1 * 3/2004 Smidt ..... E06B 9/54 160/113

(Continued)

FOREIGN PATENT DOCUMENTS

DE 841636 11/1952
DE 4016511 C2 6/1995
DE 29712864 U1 4/1998

(Continued)

*Primary Examiner* — Blair M Johnson

(57) ABSTRACT

A covering device comprises a 1st cover which has a plurality of 1st slats interconnected in an articulated manner and a 2nd cover which has a plurality of 2nd slats interconnected in an articulated manner. The covers can each be adjusted between a rest position and a covering position, said covers facing each other with slat end faces when in the covering position. At least one of the 1st slats comprises a 1st engagement part on its end face facing the 2nd slats and at least one of the 2nd slats comprises a 2nd engagement part on its end face facing the 1st slats, said 1st engagement part being able to be brought to engage with the 2nd engagement part such that the first cover is connected to the 2nd cover.

10 Claims, 6 Drawing Sheets

(56) References Cited

U.S. PATENT DOCUMENTS 8,235,086 B2 8/2012 Smith

FOREIGN PATENT DOCUMENTS

DE 19915639 C2 3/2003
DE 102010043475 2/2015

* cited by examiner

COVERING DEVICE

TECHNICAL FIELD

The invention relates to a covering device with interconnected slats, and more particularly to a covering device with a 1st cover and a 2nd cover that can each be adjusted between a rest position and a covering position and that face each other with their respective slat end faces when in a covering position.

BACKGROUND

Window roller shutters (hereafter: roller shutters) are usually rolled up on a shaft at the top of the window from which they are unrolled until the adjacent, horizontally arranged slats form a mainly vertical cover. In order to allow the roller shutter to be rolled up on the shaft, the slats are connected each to their adjacent slats in an articulated manner such that they can perform a relative pivoting motion about an axis arranged parallel to the longitudinal axis of the slats.

In order to ensure a reliable, reproducible motion of the roller shutter or slats while operating the roller shutter between the rolled-up rest position on the shaft and the rolled-out covering position, it is typically the case that the slat end faces are inserted into lateral guide rails and can slide along these guide rails.

Architecture may include so-called upright-less window corners in which the glass panes meet at an angle of e.g. 90° and are bonded directly to each other, in particular with an adhesive, without the use of an additional corner upright. When attempting to cover both windows with roller shutters, the problem arises that one either has to install a guide rail immediately in front of the corner formed by the glass panes (which is not aesthetically pleasing) or has to do without a guide rail for the roller shutters in this area, which makes the roller shutters unstable and renders operation of said roller shutters unreliable. Roller Shutters are therefore not usually used in this case. Instead, alternate solutions are employed that are less ideal than roller shutters in terms of thermal insulation, sound-proofing, and burglary protection.

SUMMARY

The object of the present invention is to create a covering device of the named type that allows a 1st cover or 1st roller shutter and a 2nd cover or 2nd roller shutter, with the slat end faces facing each other, to be guided reliably without having to install a guide rail.

This problem is solved according to the invention by a covering device with the characteristics as in claim 1. It provides that a plurality of the 1st slats comprises a 1st engagement part on their end faces facing the 2nd slats, that a plurality of the 2nd slats comprises a 2nd engagement part on their end faces facing the 1st slats, and that the 1st engagement part is able to be brought to engage with the 2nd engagement part in such a manner that the 1st cover is connected with the 2nd cover.

Covers are used in a wide range of applications. The following description assumes window roller shutters for illustration purposes. However, similar covers with slats are also used in furniture and roller gates and roller grills. Any elements of a cover interconnected in an articulated manner are referred to as slats.

According to the invention, the basic idea is that the two covers or roller shutters, for example in the area of an upright-less window corner, mutually support and guide each other while adjusting them into the covering position and also once the covering position has been reached. In this manner, one can forgo arranging a guide rail in the area of an upright-less window corner where the two covers meet.

The engagement parts are preferably made of aluminum or formed as plastic parts which are each inserted into the slats, which are usually formed as hollow profiles and said engagement parts can for example be held by clamping or detent. In a further embodiment of the invention it is provided that a plurality of 1st slats of the 1st cover each comprise a 1st engagement part and a plurality of 2nd slats of the 2nd cover each comprise a 2nd engagement part. The more 1st and 2nd engagement parts interact and engage in pairs, the better the two covers will guide and support each other. All 1st slats of the 1st cover are therefore preferably fitted with a 1st engagement part and all 2nd slats of the 2nd cover with a respective 2nd engagement part.

In many applications, roller shutters or covers are used for darkening. A preferred embodiment of the invention therefore provides that the 1st and 2nd engagement parts of the 1st and 2nd slats at least partially cover or in particular completely seal the gap formed between the two covers, so that the two covers in their covering position can form two completely darkening wall elements arranged at an angle.

The 1st engagement part can be brought into a force-locking engagement with the 2nd engagement part, e.g. latched. However, it is preferable that the 1st engagement part is in positive engagement with the 2nd engagement part since this ensures a reliable engagement over a long service life.

In order to increase the stability of the 1st cover, in a further embodiment of the invention it can be provided that the 1st engagement part of a 1st slat is engaged with the 1st engagement part of an adjacent 1st slat, wherein this can preferably also be a positive engagement. In this manner, the stability of the 1st cover is increased in the covering position.

In a similar manner or alternatively, it can also be provided that the 2nd engagement part of a 2nd slat is engaged, in particular in positive engagement, with the 2nd engagement part of an adjacent 2nd slat, such the stability of the 2nd cover in the covering position is increased.

In order to increase the stability of the entire covering device, i.e. the engaged 1st and 2nd cover, a further extension of the invention may provide that the 1st engagement part of a 1st slat can be engaged with two 2nd engagement parts of two adjacent 2nd slats. Alternatively or additionally the 2nd engagement part of a 2nd slat may engage with two 1st engagement parts of two adjacent 1st slats, wherein the engagement is again preferably a positive engagement in each case.

Alternatively or additionally the 1st engagement part of the 1st slat of the 1st cover may engaged with the 2nd engagement part of a 2nd slat of the 2nd cover, which is vertically offset relative to the 1st slat, e.g. is engaged with a 2nd slat obliquely arranged above or below.

If the 1st cover is formed of a 1st roller shutter and the 2nd cover of a 2nd roller shutter of conventional design, adjacent 1st slats of the 1st cover and adjacent 2nd slats of the 2nd cover perform a pivoting motion relative to each other when the roller shutters are adjusted between the rest position and the covering position, i.e. when unrolling the slats from the shaft. According to the invention, this pivoting motion can preferably be used to bring into engagement the 1st engagement parts of the 1st slats with the 2nd engagement parts of the 2nd slats.

The invention can be extended so that the 1st engagement part of a 1st slat can be adjusted relative to the 1st engagement part of an adjacent 1st slat by translation in the vertical direction while remaining engaged with said 1st engagement part during this process, for instance if the two 1st slats are lowered or raised relative to each other in order to open or close a light gap between the two 1st slats. In the same manner, the 2nd engagement part of a 2nd slat can be adjusted relative to the 2nd engagement part of an adjacent 2nd slat.

According to the invention, it is preferably provided that the 1st cover and the 2nd cover in their respective covering position form an angle $\alpha$ with each other, where $\alpha$ should range between 30° and 180°. For upright-less window corners, $\alpha$ usually ranges between 60° and 120° and in many cases the two covers meet at an angle of $\alpha$=90°.

Further details and characteristics of the invention can be seen in the following description of an embodiment with reference to the drawing.

DETAILED DESCRIPTION

Figure 1:
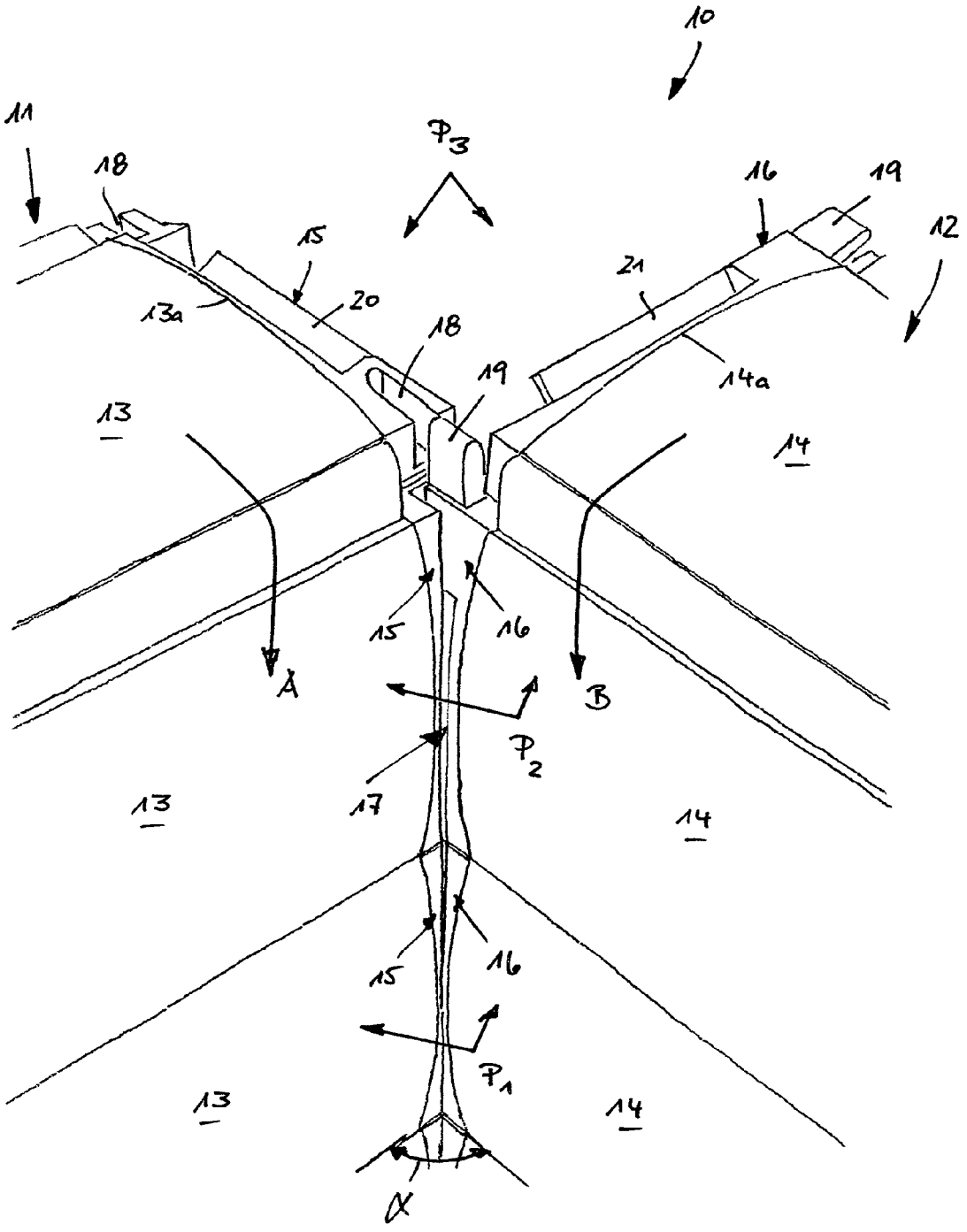
FIG. 1. A detail of a 1st and a 2nd cover in the 1st phase of engagement of the 1st and 2nd engagement parts, FIG. 2. a 2nd phase of the engagement of the 1st and 2nd engagement parts, FIG. 3. a 3rd phase of the engagement of the 1st and 2nd engagement parts, FIG. 4. a 4th phase of the engagement of the 1st and 2nd engagement parts, and FIG. 5. a 5th phase of the engagement of the 1st and 2nd engagement parts.
Figure 6:
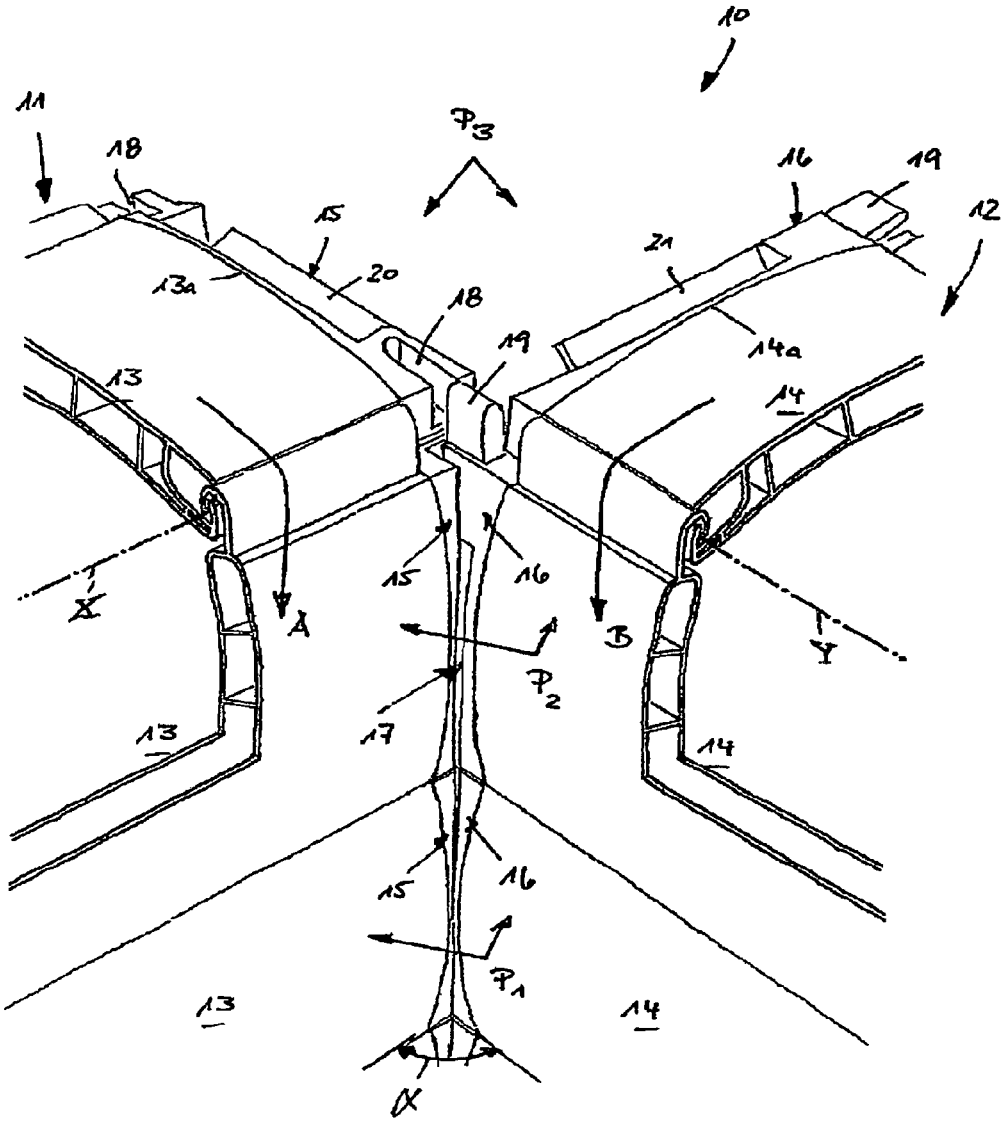
FIG. 6. as FIG. 1, with additional partial section to depict the hinged connection.

FIG. 1 shows a detail of the covering device 10 according to the invention, which has a 1st cover 11 in form of a 1st roller shutter and a 2nd cover 12 in form of a 2nd roller shutter. The 1st cover 11 has a plurality of parallel 1st slats 13, which are conventionally connected in an articulated manner. That is, as shown in FIG. 6, the 1st slats 13 are hingedly connected to one another along their adjacent longitudinal edges by a hinge (22), which is formed by an upwardly extending flange with a downwardly opening hook 13*b* on the upper edge of the slat 13 and a bent hook 13*c* on the lower edge of the adjacent slat 13. Thus the slats 13 can pivot relative to each other about an axis X, which is defined by the hinge 22 and which is parallel to the longitudinal axis of the slats 13. Each slat 13 comprises a 1st engagement part 15 at its lateral end face 13*a* facing the 2nd cover 12. The 1st engagement part 15 is inserted into the associated hollow profile of the 1st slat 13, and comprises a recess 18 in its lower end region and a laterally protruding engagement ridge 20.

The 2nd cover 12 also has a plurality 2nd slats 14 arranged parallel to each other, which are connected in an articulated manner as described and can pivot relative to each other about an axis Y, which is defined by the hinge 23, which is formed by an upwardly extending flange with a downwardly opening hook 14*b* on the upper edge of the slat 14 and a bent hook 14*c* on the lower edge of the adjacent slat 14, as shown in FIG. 6. A 2nd engagement part 16 each is mounted to the respective end face 14*a* of the 2nd slat 14, for instance by being inserted into the related 2nd slat 14 formed as a hollow profile. The 2nd engagement part 16 also comprises an engagement ridge 21 and a tab 19 at its top that can be brought into engagement with the recess 18 of the 1st engagement part 15.

Both the 1st cover 11 and the 2nd cover 12 can be adjusted from a rest position, for example a position rolled up on a shaft that is not shown, to a covering position in which the respective 1st or 2nd slats each form a usually vertical covering wall. While lowering the 1st cover 11 from the rest position to the covering position, the adjacent 1st slats 13 pivot relative to each other about an axis X, in that each 1st slat 13 in the depicted embodiment moves from a mostly horizontal orientation to a vertical orientation as indicated by arrow A. At the same time, the adjacent 2nd slats 14 pivot similarly relative to each other about an axis Y while lowering the 2nd cover 12 from the rest position and the covering position as indicated by arrow B in FIG. 1.

FIGS. 1 to 5 show the covering device 10 in various phases of being lowered from the rest position to the covering position, wherein the 1st cover 11 moves from top to bottom as indicated by arrow A and the 2nd cover 12 moves from top to bottom as indicated by arrow B.

FIG. 1 shows three 1st slats 13 and three 2nd slats 14, wherein a 1st slat 13 and a 2nd slat 14 form a slat pair each as they interact, so that a lower 1st slat pair P1, a middle 2nd slat pair P2, and a top 3rd slat pair P3 are depicted in FIG. 1. For the lower 1st slat pair P1, and the middle 2nd slat pair P2, the slats 13, 14 are already oriented vertically. The relating 1st and 2nd engagement parts 15, 16 are already engaged with each other and mutually support slats 13, 14. As shown in FIG. 1, the gap 17 formed between the two covers 11 and 12 in the vertical direction of the slats 13 and 14 is completely sealed by the engaged engagement parts 15, 16. The two slats 13 and 14 of the top 3rd slat pair P3 are still in the horizontal orientation and are pivoted into a vertical orientation during the further downward movement of the covering device 10, as indicated by the arrows A' and B' in FIG. 2.

The following is a detailed description of the movement performed by the two slats 13 and 14 of the top 3rd slat pair P3, which engage with each other via their engagement parts 15 and 16 as they are stood upright into the vertical position.

Figure 2:
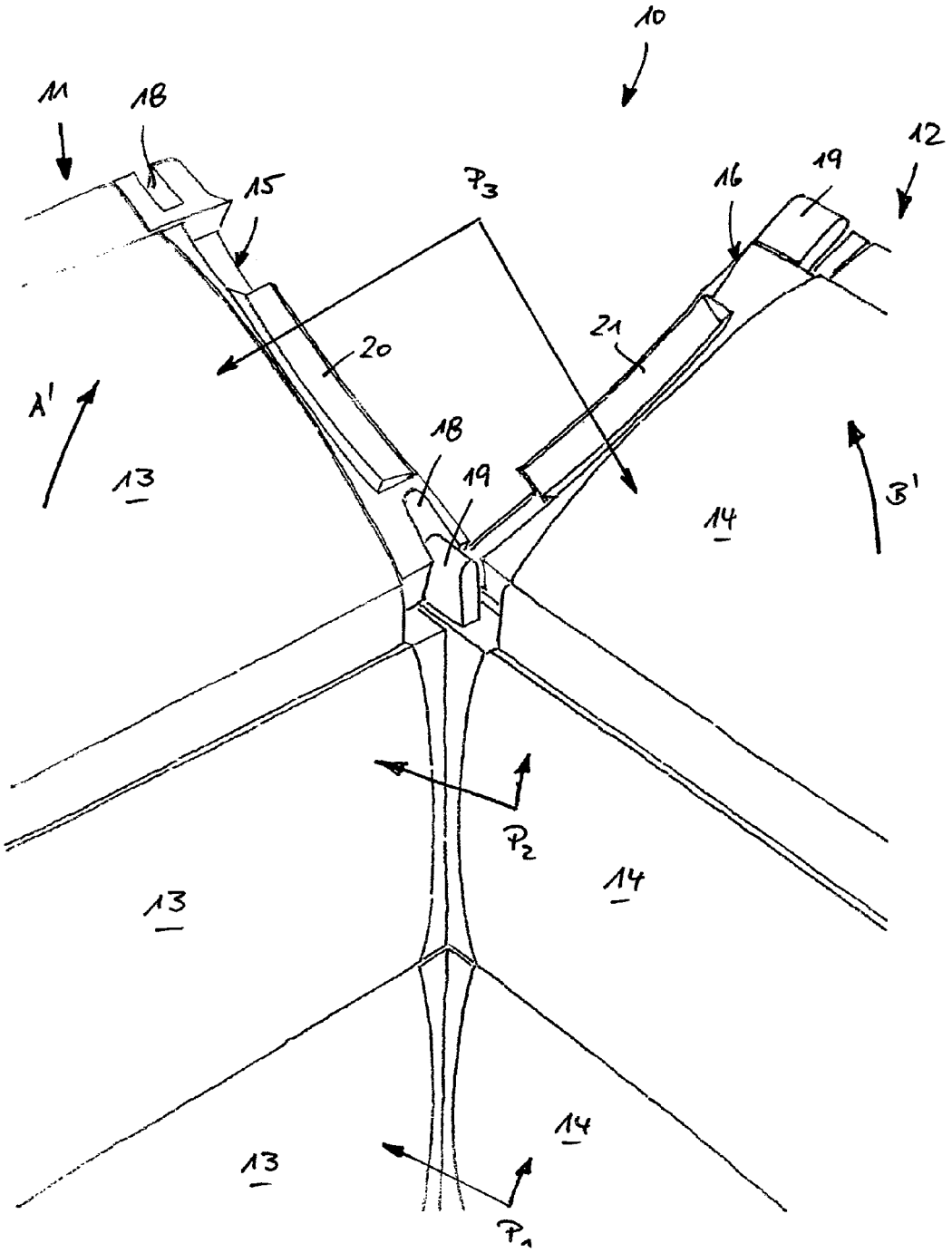

In the initial position depicted in FIG. 1, a tab 19 freely protrudes upwards from the 2nd engagement part 16 of the middle 2nd slat pair P2. Since both slats 13 of the top slat pair P3 are still in their horizontal orientation, the two engagement parts 15 and 16 are also not yet engaged. When the two covers 11 and 12 are moved downwards in a synchronized manner pursuant to FIG. 1, both slats 13 and 14 of the top 3rd slat pair P3 pivot into a vertical orientation as indicated by arrows A' and B'. In a 1st phase of this uprighting motion, as shown in FIG. 2, the recess 18 of the 1st engagement part 15 partially engages with the tab 19 of the 2nd engagement part 16 of the 2nd middle slat pair P2. This situation is depicted in FIG. 2.

Figure 3:
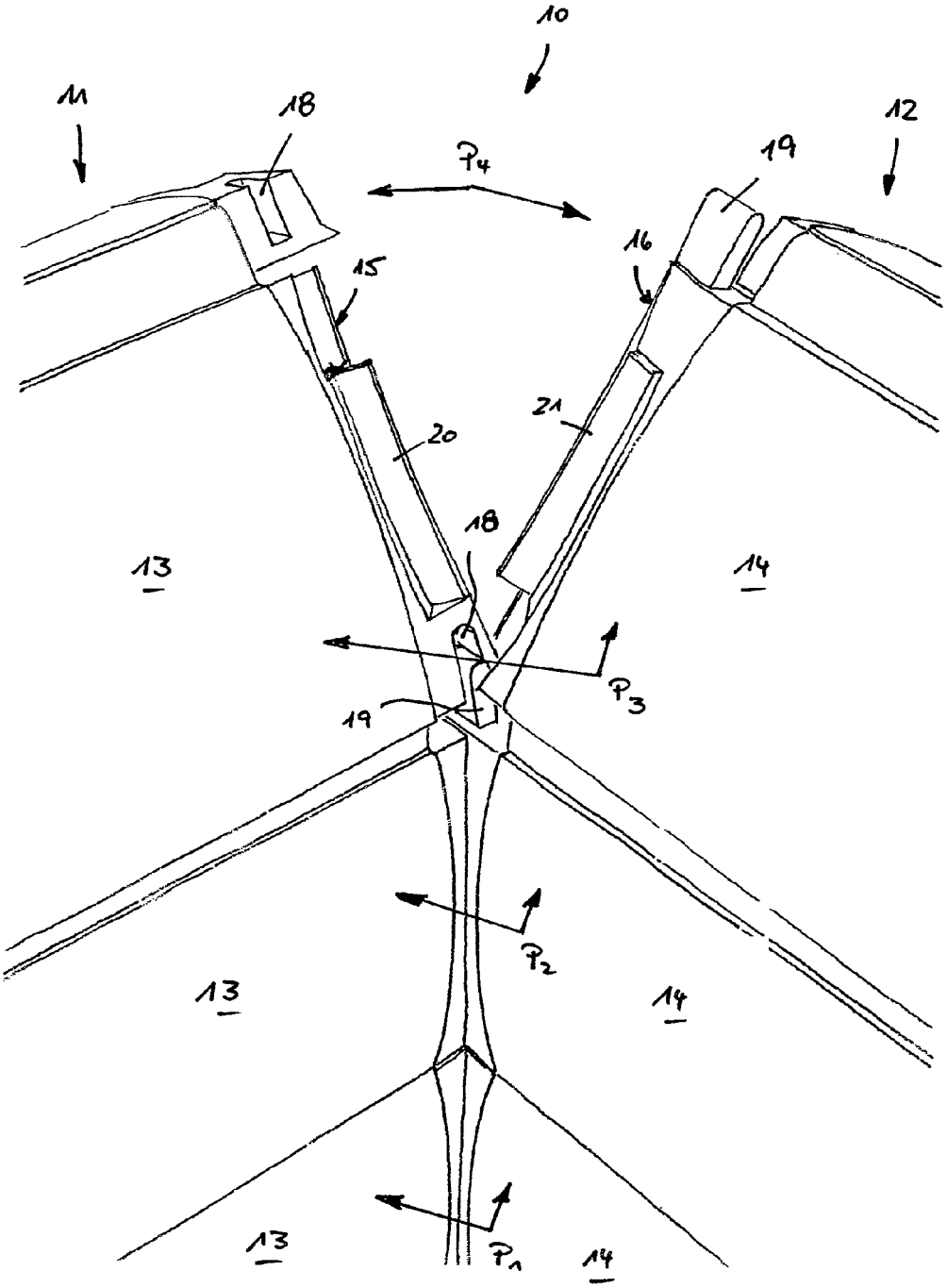

FIG. 3 shows a further, subsequent phase of the operation, wherein the two slats 13 and 14 of the top 3rd slat pair P3 are each in a partially upright position at an angle of approximately 45°. The two engagement parts 15 and 16 move towards each other and tab 19 engages even further into recess 18. The top of FIG. 3 already shows the next, 4th slat pair P4, which is subsequently engaged in the same manner.

Figure 4:
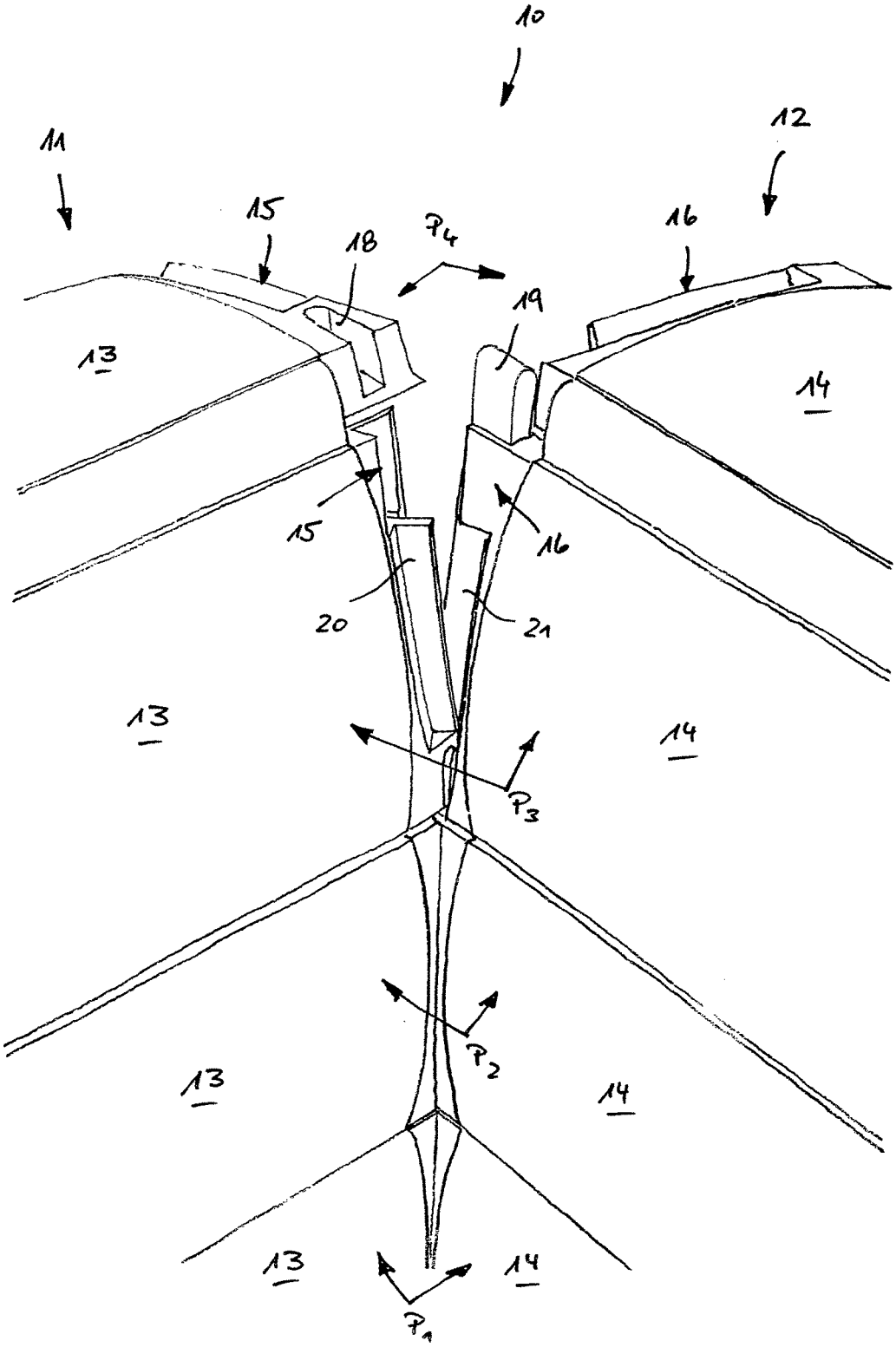
Figure 5:
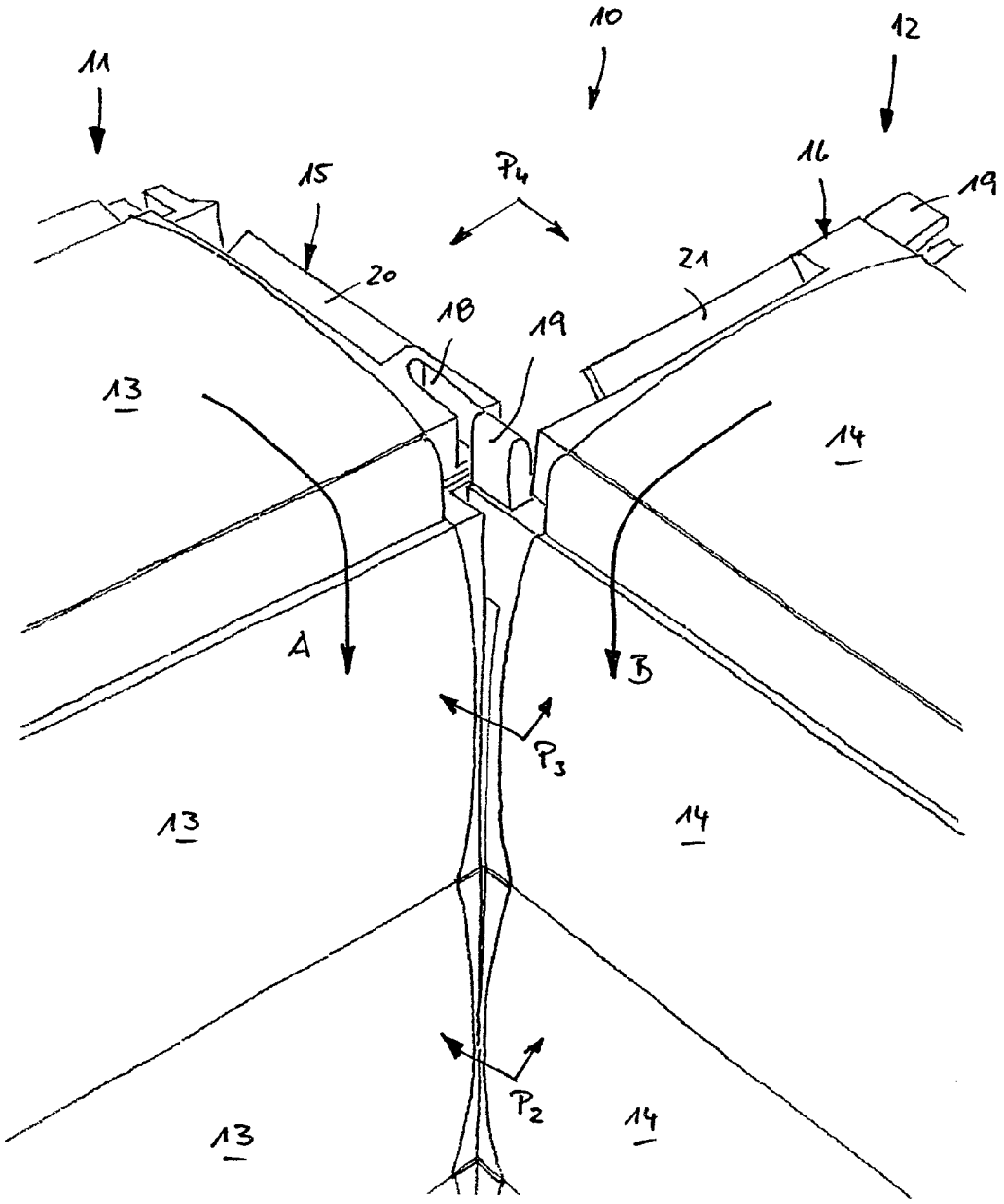

In FIG. 4, the two slats 13 and 14 have almost reached their vertical orientation. At this point, the two engagement ridges 20 and 21 engage with each other. As the covering device 10 continues to move downward, the two engagement ridges 20 and 21 engage completely, so that the gap 17 between the two slats 13 and 14 of the 3rd slat pair P3 is now completely sealed, as depicted in FIG. 5. FIG. 5 again shows the state in FIG. 1 with cover 10 having shifted downwards by one slat pair and slats 13 and 14 of the following 4th slat pair P4 now lining up to engage with each other.

The invention claimed is:

1. A covering device (10), comprising:

a first cover (11) having first and second lateral edges and comprising a plurality of first slats (13) which are hingedly connected to one another along longitudinal edges thereof, each of the first slats (13) having a first end face (13*a*);

a second cover (12) having first and second lateral edges and comprising a plurality of second slats (14) which are hingedly connected to one another along longitudinal edges thereof, each of the second slats (14) having a second end face (14*a*);

a first engagement part (15) provided on the first end face (13*a*) of a plurality of the first slats (13); and a second engagement part (16) provided on the second end face (14*a*) of a plurality of the second slats (14), wherein the covers (11,12) can be moved between a retracted, rest position and a deployed, covering position, and wherein one of the lateral edges of the first cover engages an adjacent one of the lateral edges of the second cover in the deployed, covering position, characterized in that, when the covers (11,12) are moved into their deployed, covering position, adjacent first slats (13) of the first cover (11) and adjacent second slats (14) of the second cover 12) pivot about an axis (X,Y) which is defined by their hinged connections, which are parallel to the longitudinal axis of the respective slats (13, 14), and the first engagement parts (15) connect with the second engagement parts (16) by this pivoting as the first cover (11) engages the second cover (12).

2. The covering device as in claim 1, wherein the 1st engagement parts (15) and the 2nd engagement parts (16) seal a gap (17) between the 1st cover (11) and the 2nd cover (12) when in the deployed, covering position.

3. The covering device as in claim 1, wherein the 1st engagement part (15) is in positive engagement with the 2nd engagement part (16) when in the deployed, covering position.

4. The covering device as in claim 1, wherein the 1st engagement part (15) of one of the plurality of 1st slats (13) is engaged with the 1st engagement part (15) of an adjacent one of the plurality of 1st slats (13) when in the deployed, covering position.

5. The covering device as in claim 1, wherein the 2nd engagement part (16) of one of the plurality of 2nd slats (14) is engaged with the 2nd engagement part (16) of an adjacent one of the plurality of 2nd slats (14) when in the deployed, covering position.

6. The covering device as in claim 1, wherein the 1st engagement part (15) of one of the plurality of 1st slats (13) engages two 2nd engagement parts (16) of at least one of the plurality of 2nd slats (14) when in the deployed, covering position.

7. The covering device of claim 1, wherein each of the first and second slats define a central, longitudinal axis, at least one of said first and second slats being connected with at least one of the other of the first and second slats whose axis aligns or intersects therewith.

8. The covering device as in claim 1, wherein the 1st cover (11) and the 2nd cover (12) are arranged relative to each other at an angle between 30° and 180° when in the deployed covering position.

9. The covering device as in claim 1, wherein the 1st cover (11) and the 2nd cover (12) are arranged relative to each other at an angle between 60° and 120° when in the deployed covering position.

10. The covering device of claim 1, wherein each of the first and second slats define a central, longitudinal axis, at least one of said first and second slats being connected with at least one of the other of the first and second slats whose axis do not align or intersect therewith.

* * * * *